United States Patent [19]

Bayles et al.

[11] 4,274,687

[45] Jun. 23, 1981

[54] SUSPENSION FILE ASSEMBLY

[75] Inventors: Richard A. Bayles, 8 Idlewild Park Dr., Cornwall-on-Hudson, N.Y. 12520; Philip Shuster, Monsey, N.Y.

[73] Assignee: Richard A. Bayles, Cornwall-on-Hudson, N.Y.

[21] Appl. No.: 38,892

[22] Filed: May 14, 1979

[51] Int. Cl.[3] ..... A47B 45/00; A47G 29/02

[52] U.S. Cl. ..... 312/205; 312/257 SK; 248/188.7; 248/243; 211/126; 108/152

[58] Field of Search ..... 312/257 SK, 257 A, 205; 211/94, 88, 126; 108/152, 109; 248/188.7, 188.8, 188.9, 243

[56] References Cited

U.S. PATENT DOCUMENTS

| | | | |
|---|---|---|---|
| 3,181,703 | 5/1965 | Dunham | 211/126 |
| 3,512,654 | 5/1970 | Olsen et al. | 248/243 |
| 3,517,623 | 6/1970 | Goldstein et al. | 248/243 |
| 3,520,507 | 7/1970 | Strong | 248/188.9 |
| 3,601,432 | 8/1971 | Fenwick | 248/243 |
| 3,617,023 | 11/1971 | Schneiderman | 248/188.7 |
| 3,730,108 | 5/1973 | Stroh | 248/243 |
| 3,833,279 | 9/1974 | Mackenzie, Jr. | 312/257 SK |
| 3,921,539 | 11/1975 | Berger | 248/188.8 |
| 4,131,203 | 12/1978 | Bridges | 211/88 |
| 4,154,493 | 5/1979 | Prater | 312/257 SK |

*Primary Examiner*—Victor N. Sakran
*Attorney, Agent, or Firm*—Edward F. Levy

[57] ABSTRACT

A suspension file assembly includes a pair of spaced leg assemblies which support a plurality of horizontal suspension members on which a plurality of storage bins are suspended. The assembly according to the invention features leg extension members which may be attached to the leg assemblies to increase the stability of the assembly in order to accommodate various size loads extending both to the front and to the rear of the leg assemblies.

10 Claims, 7 Drawing Figures

FIG. 3
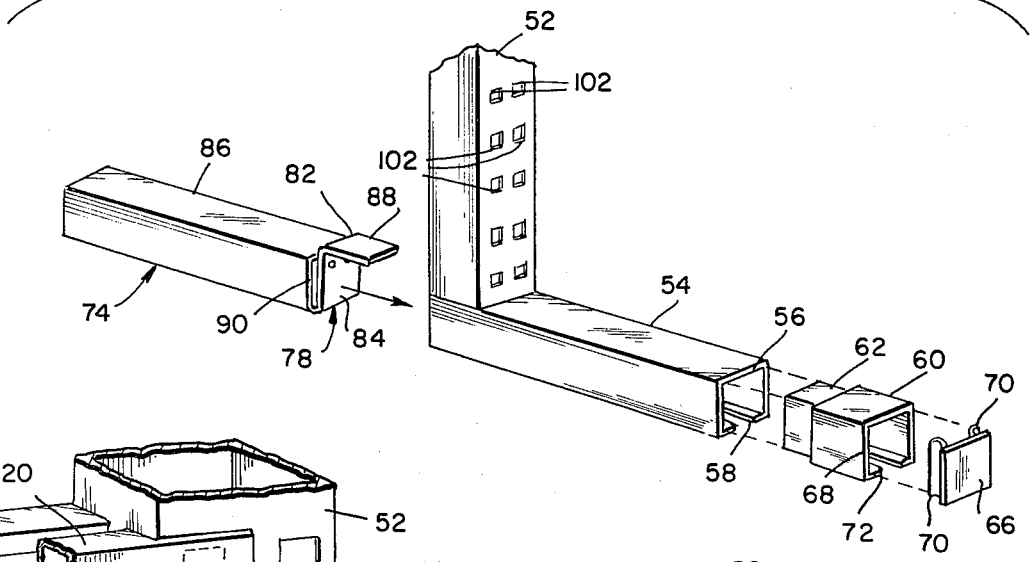
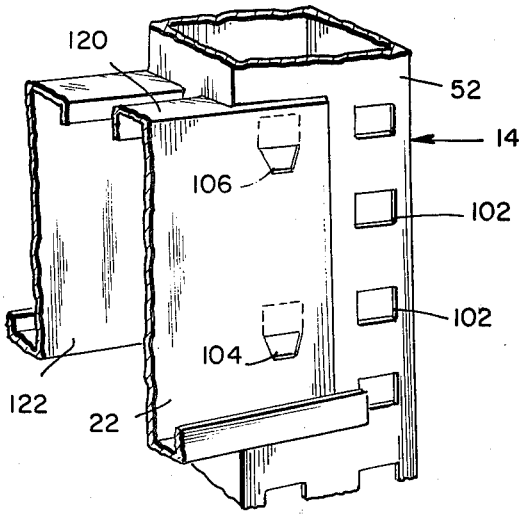
FIG. 6
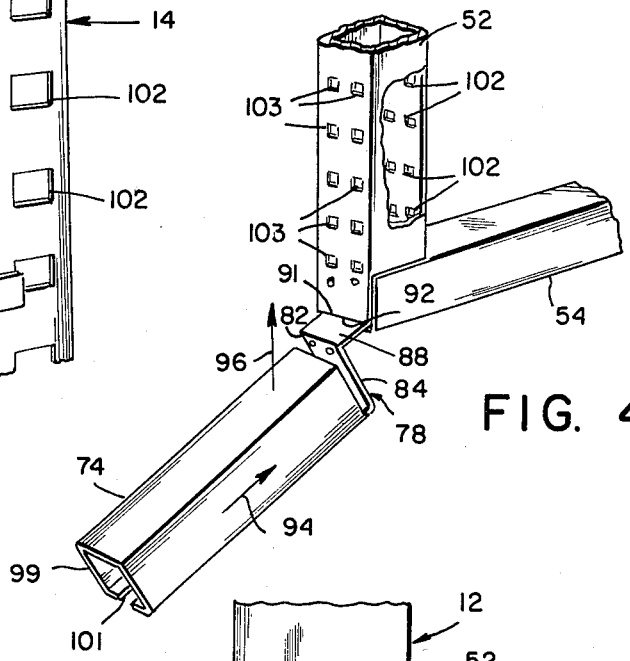
FIG. 4
FIG. 5
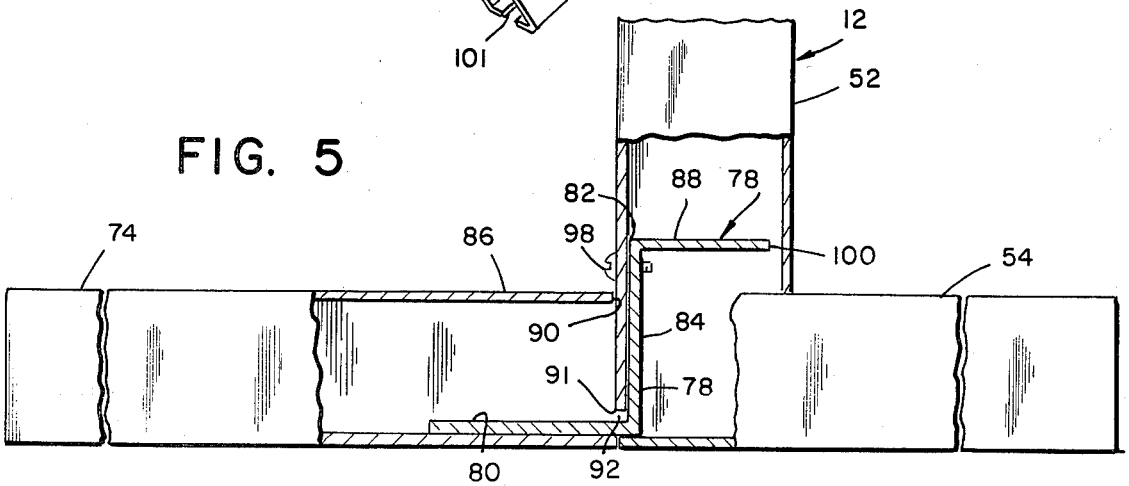

SUSPENSION FILE ASSEMBLY

The present invention relates generally to apparatus for the storage of records and more particularly to a novel suspension file assembly.

There is a continuing need in the field of office equipment for efficient and flexible apparatus for the storage of records. Conventional filing cabinets have been found to be neither efficient nor flexible. A change, for example, in the size of the records utilized by an office from standard 8½ inch by 11 inch records to legal size, 8½ inch by 14 inch, or to a metric size requires a complete change in conventional filing equipment including the purchase of new equipment and the disposal of old equipment. An increase in the number of records stored, similarly results in a requirement for the purchase of additional filing cabinets and results in a significant cost impact.

It is an object of the present invention to provide a suspension file assembly which overcomes the deficiencies of the prior art and permits rapid and relatively low cost modification to accommodate the storage of additional records.

Another object of the present invention is to provide a suspension file assembly which may be altered to any one of a variety of configurations through the addition of a few relatively simple component parts.

Another object of the present invention is to provide a suspension file assembly which may be shipped in a disassembled state thereby resulting in relatively low shipping costs and which may be quickly assembled into an operating condition.

Another object of the present invention is to provide a suspension file assembly which can accommodate various size records.

Another object of the present invention is to provide a suspension file assembly which provides relatively great stability even when fully loaded.

Still another object of the present invention is to provide a suspension file assembly which comprises a relatively small number of simple parts which are economical of manufacture.

In accordance with the present invention there is provided a suspension file assembly comprising a pair of spaced apart leg assemblies, a plurality of horizontal suspension members which extend between and are supported by the leg assemblies and a plurality of record storage bins which are suspended from the horizontal suspension members. The leg assemblies include an upright member rigidly attached to a horizontal member, and two types of leg extension member which form a major feature of the invention. The first leg extension member is inserted into the horizontal member extending the length of the horizontal member and increasing the stability of the suspension file assembly thereby permitting the use of the suspension file assembly for large loads. The second leg extension member is metal formed in the shape of a square as is the upright member and includes a Z-shaped bracket, the lower member of which is attached to the second leg extension member and the intermediate and upper member of which project into the upright member. A pair of threaded fasteners connect the upright member and the intermediate member of the Z bracket forming a joint of exceptional rigidity. The second leg extension member is directed opposite to the horizontal member and enables the suspension file assembly to accommodate storage bins hanging from horizontal suspension members and projecting both to the rear and to the front of the leg assemblies thereby expanding the storage capacity of the suspension file assembly.

Additional objects and advantages of the invention will become apparent during the course of the following specification when taken in connection with the accompanying drawings in which:

FIG. 3 is a fragmentary exploded perspective view of a leg assembly of the suspension file assembly of FIG. 1 showing the installation of an extension member and a rear horizontal member;

FIG. 4 is a fragmentary perspective view of the lower portion of the leg assembly of FIG. 3 showing the rear horizontal member partially inserted into the leg assembly;

FIG. 5 is a fragmentary side elevation view of the leg assembly of FIG. 3, with portions broken away and shown in section to reveal details of internal construction; and FIG. 6 is a fragmentary perspective view of an intermediate portion of the leg assembly of FIG. 3, drawn to an enlarged scale and showing the attachment of a pair of horizontal suspension members to the leg assembly.

Figure 1:
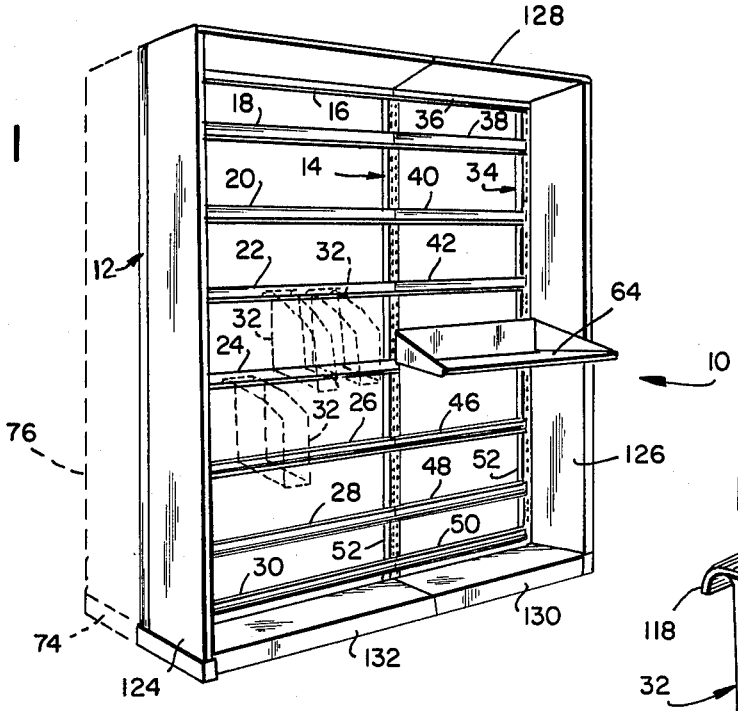
FIG. 1 is an overall perspective view of a suspension file assembly made in accordance with the present invention, with portions of the suspension file assembly shown in broken lines.

Referring in detail to the drawings, there is shown in FIG. 1 a suspension file assembly 10 made in accordance with the present invention, which, in its simplest configuration, comprises a pair of spaced apart leg assemblies 12, 14 which support a plurality of horizontal suspension members 16, 18, 20 22, 24, 26, 28, 30 and a plurality or record bins 32 which are mounted on said horizontal suspension members.

Figure 2:
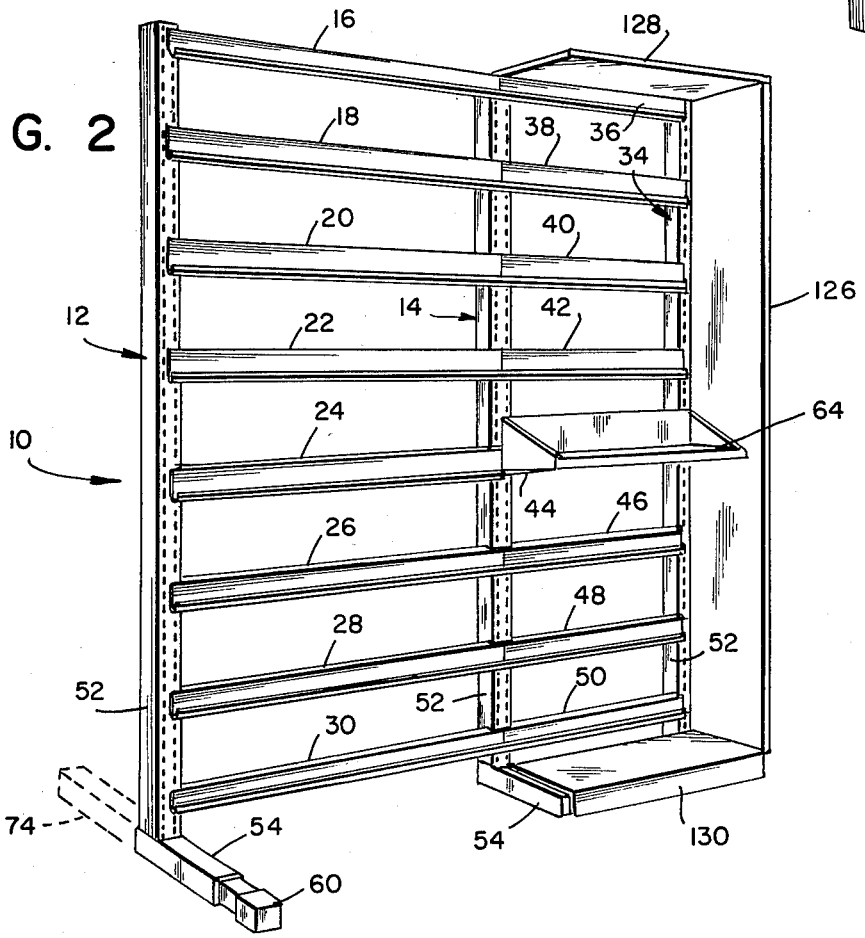
FIG. 2 is a perspective view of the suspension file assembly of FIG. 1 drawn to an enlarged scale and with selected top side and bottom panels removed to show details of construction.

In the embodiments shown in FIGS. 1 and 2 the suspension file assembly is shown to be of double width by the addition of a third upright leg assembly 34 and eight additional horizontal suspension members 36, 38, 40, 42, 44, 46, 48, 50. These additional horizontal suspension members extend between and are mounted upon the leg assemblies 14 and 34, in alignment with the respective horizontal suspension members 16, 18, 20, 22, 24, 26, 28 and 30. It is understood that this embodiment is illustrated by way of example only, and that a single pair of leg assemblies with horizontal members extending between them may be used for limited volume record storage applications or alternatively, a plurality of additional leg assemblies may be connected in a manner to be presently described, forming as large a storage capacity as is desired.

As shown in FIGS. 2 and 3, the leg assemblies 12, 14, 34, each include a vertical member 52 and a horizontal member 54 which is welded or otherwise permanently attached to the lower end of the vertical member 52. In the preferred embodiment of the invention, shown in the drawings, the vertical and horizontal members 52 and 54 are each formed of sheet metal bent to provide a hollow body having a square cross-section, and made of a suitable material such as twelve gauge steel. As is best shown in FIG. 3, the ends of the bent metal sheet are spaced from each other to form a longitudinal slot 58. The leg assembly also includes an extension member 60 provided with a stepped portion 62 of slightly reduced cross-sectional area, and which is sized to fit tightly into the open end 56 of the horizontal member 54. The slotted portion 58 of the horizontal member 54 provides a degree of compliance at the end 56 of the horizontal member 54, enabling the extension member 60 to fit tightly into the horizontal member 54, thereby extending the length of the latter and providing additional stability for the suspension file assembly 10. The extension member 60 enables the suspension file assembly 10 to accommodate loads which are unusually heavy, or which project in front of the vertical member 52 a distance greater than the conventional length of $8\frac{1}{2}$ inch by 11 inch papers or file jackets, such as legal size records or materials placed on the work shelf 64.

An end cap 66 is provided as is shown in FIG. 3 to close the open end 68 of the extension member 60. The end cap 66 has a pair of spring members 70 which attach the end cap 66 to the extension member 60. The end 68 of the extension member 60 has a slotted portion 72 similar to the slotted portion 58 on the horizontal member 54, which slotted portion 72 enables a user to add additional extension members 60, as desired to accommodate large or otherwise unusual loads.

In order to enable the suspension file assembly 10 to be used for storing files at the rear surface thereof as well as at the front surface thereof, rear extension members 74 are provided in accordance with the invention. These rear extension members provide support for weight applied at the rear of the file assembly, and enable record bins 32 to be disposed projecting from the rear of the leg assemblies 12, 14, 34 in the area indicated by the broken lines 76 in FIG. 1, in addition to projecting from the front of the leg assemblies 12, 14, 34. This feature enables the volume of records stored by the suspension file assembly 10 to be doubled, simply by adding appropriate components.

As shown in FIGS. 3 and 5, the rear extension member 74 is formed of square metal tubing and terminates at one end in a Z-shaped bracket 78. The Z bracket 78 includes a lower horizontal leg 80, which is fastened by welding or other suitable means to the inner surface of the rear extension member 74. The upper edge 82 of the central vertical portion 84 of the Z bracket 78 projects above extension member 74. An upper horizontal leg 88 of the Z bracket 78 projects from the upper edge 82 in a direction opposite to the direction in which the lower horizontal portion 80 projects from the lower edge of the central portion 84. The central vertical portion 84 is spaced a distance from the end edge 90 of the rear extension member 74, to provide a gap which is slightly greater than the wall thickness of the vertical member 52.

FIGS. 4 and 5 show the manner in which the vertical members 52 of the leg assemblies 12, 14 and 34 are mounted upon and secured to the horizontal base members 54. It will be seen that the lower edge 91 of the rear wall of each vertical member 52 is spaced a short distance above the bottom wall of the respective hollow horizontal base member, to provide a narrow elongated slot 92 therebetween. The width of the slot 92 is slightly greater than the thickness of the Z bracket 78.

The rear extension member 74 is attached to the vertical member 52 by first inserting the upper horizontal leg 88 of the Z bracket 78 through the slot 92 in the manner shown in FIG. 4. The rear extension member 74 is first pushed inwardly, in the direction shown by the arrow 94, fully inserting the upper horizontal leg 88 within the vertical member 52. When the upper horizontal leg 88 is fully inserted, the rear extension member 74 is pushed upwardly, in the direction shown by the arrow 96, to insert the central vertical portion 84 of the Z bracket 78 within the vertical member 52. When the central vertical portion 84 is fully inserted, as shown in FIG. 5, it extends parallel to the inner surface of the rear wall of vertical member 52. A pair of self-tapping screws 98, one of which is shown in FIG. 5, are threaded through the rear face of the vertical member 52 and through the central vertical portion 84 of the Z bracket 78, thereby rigidly attaching the rear extension member 74 to the vertical member 52. The forward edge 100 of the upper horizontal leg 88 of the Z bracket 78 preferably abuts the inner surface of the front face of the vertical member 52 thereby providing an additional measure of rigidity to the leg assembly 12, although for clarity of illustration, this forward edge is shown spaced from said front face inner surface in FIG. 5.

The end 99 of the rear extension member 74 includes a slotted portion 101 similar to the slotted portion 58 on the horizontal member 54. This slotted portion 101 enables a user to add an extension member 60 to the rear extension member 74 in order to further increase the stability of the suspension file assembly 10 at the rear thereof.

The front face of each vertical member 52 has formed therein a pair of vertical rows of rectangular perforations 102, with the perforations of one row aligned horizontally with the adjacent perforations of the other row. The perforations 102 are uniform in size and are regularly spaced. The rear face of each vertical member 52 also has formed therein a double row of similar perforations 103. The perforations 102 and 103 in each of the rows are sized and positioned to accept a cluster of two projecting prongs 104 and 106 which are formed on opposite ends of each of the plurality of horizontal suspension members 16–30 and 36–50, in a manner which is best shown in FIG. 6. The cluster of projecting prongs includes a vertically spaced pair of prongs 104 and 106 which are each horizontally oriented and sized to be received in the slots 102 and 103. As shown in FIG. 6, the first group of horizontal suspension members 16–30 are mounted at their ends on one of the vertical rows of slots 102 of vertical member 52 of the central leg assembly 14. The ends of the second group of horizontal suspension members 36–50 are similarly mounted in the other vertical row of slots 102 of the vertical member 52 of the central leg assembly 14.

Figure 1A:
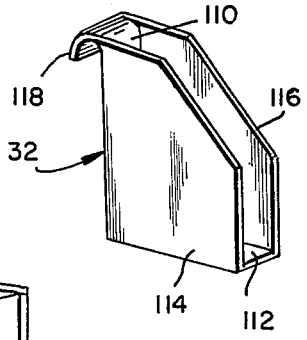
FIG. 1A is an enlarged perspective view of a record bin shown removed from the suspension file assembly of FIG. 1.

The horizontal suspension members 16–30 and 36–50 are each adapted to support a plurality of record bins 32, some of which are shown in broken line in FIG. 1. A single record bin 32, drawn to an enlarged scale, is shown in FIG. 1A. The record bin 32 includes integrally formed back panel 110, bottom panel 112 and side panels 114, 116 and a hook portion 118 which projects from the upper end of back panel 110.

In use, the hook portion 118 of the record bin 32 is hooked onto a top flange 120 (FIG. 6) formed on the upper edge of each of the horizontal suspension members. The lower portion of the record bin 32 rests against a lower horizontal suspension member thereby maintaining the alignment of the record bin 32. As is best shown in FIG. 6, a second horizontal suspension member 122 may be mounted on the central vertical member 52 directly behind the horizontal suspension member 22 for the purpose of mounting additional record bins which are directed toward the rear of the suspension file assembly 10.

The record bins 32 in the preferred embodiment are integrally molded in a suitable plastic and may be furnished in a variety of colors to facilitate rapid catagorization of the records being stored. Alternatively, the record bins may be formed of sheet metal. The record bins may be easily arranged and rearranged within the suspension file assembly 10 simply by unhooking them from the horizontal members and moving them to a new horizontal member or to a new position on the original horizontal member.

As shown in FIG. 1, a work shelf 64 is attached to one or more of the horizontal suspension members in a manner similar to the mounting of record bins 32.

Rectangular side panels 124, 126 are provided, each of which are secured to the outer side surfaces of the vestical members 52 of the respective leg assemblies 12 and 34, by attachment means (not shown) which may be in the nature of protruding tabs or prongs which engage the outer row of perforations 102 on the vertical members 52 on which they are mounted. The side panels 124, 126 may be mounted projecting to the front of the leg assemblies, as shown in FIG. 2, and additional side panels may be provided projecting to the rear of the leg assemblies as indicated by the broken lines 76 in FIG. 1. A top panel 128 which is supported by the side panels 124, 126 and by the upper horizontal suspension member 16 is provided and base panels 130, 132, which cover over and are supported by the horizontal members 54, are also provided.

The leg assemblies 12, 14 and 34 have been shown and described as formed of hollow members of square shape. It is understood that a rectangular shape in metal may also be utilized.

While a preferred embodiment of the invention has been shown and described herein, it is obvious that numerous omissions, changes and additions may be made in such embodiment without departing from the spirit and scope of the invention.

What is claimed is:

1. A suspension file assembly comprising a plurality of spaced apart leg assemblies, each including an upright vertical member supported by a horizontal base member, a plurality of horizontal suspension members extending between said vertical members and having connecting means for removably mounting said suspension members on said vertical members, whereby said horizontal suspension members are supported by said leg assemblies, a plurality of record storage bins adapted to be suspended from said horizontal suspension members, said horizontal base members being rigidly affixed to the bottom end of the respective vertical members and projecting perpendicularly from the forward face thereof only in a forward direction to support the weight of said bins suspended on the forward face of said horizontal suspension members, a plurality of auxiliary horizontal base members, and means including a tongue-and-slot coupling for selectively and removably mounting said auxiliary members on the lower end of the respective vertical members with said auxiliary members being aligned with the respective horizontal base member and projecting perpendicularly from the rear face of said vertical members in a direction opposite to said horizontal base members, whereby to support the weight of bins suspended on the rear face of said horizontal suspension members.

2. A suspension file assembly according to claim 1 in which said vertical members, horizontal base members and auxiliary base members are hollow metal members having straight sides.

3. A suspension file assembly according to claim 2 in which the rear wall of each vertical member terminates a short distance above the bottom wall of the connected horizontal base member to define a narrow slot therebetween, said means for mounting said auxiliary members comprising a Z shaped bracket having an upper horizontal arm, a central vertical section, and a lower horizontal arm extending perpendicularly from said central vertical section in a direction opposite to said upper horizontal arm, said lower horizontal arm being inserted within an open end of said auxiliary horizontal base member and secured therein, with said central vertical section spaced from said open end of said auxiliary horizontal base member.

4. A suspension file assembly according to claim 3 in which the upper horizontal arm of said Z shaped bracket is insertible through said narrow slot in said vertical member to bring the central vertical section of said Z shaped bracket to a mounted position within said vertical member, with said central vertical section extending parallel to the rear wall of said vertical member.

5. A suspension file assembly according to claim 4 which also includes a threaded fastener member for connecting said central vertical section and the rear wall of said vertical member.

6. A suspension file assembly according to claim 1 which also includes leg extension means adapted to be removably attached to the free ends of said horizontal base members and said auxiliary horizontal base members.

7. A suspension file assembly according to claim 6 in which said horizontal base members and auxiliary horizontal base members are made of hollow metal members having straight sides, and in which said leg extension means comprises a leg member having an end portion sized to fit closely within the free end of a base member.

8. A suspension file assembly according to claim 7 in which the free end of each horizontal base member and auxiliary base member includes a slotted portion for facilitating insertion of the end portion of said leg member into the free end of said base member.

9. A suspension file assembly according to claim 2 in which said straight sided hollow members are rectangular shaped.

10. A suspension file assembly according to claim 7 in which said horizontal base members and auxiliary horizontal base members are made of metal in a rectangular shape, and in which said leg members are also made of metal in a rectangular shape.

* * * * *